US005667482A

United States Patent [19]

Cheng

[11] Patent Number: 5,667,482

[45] Date of Patent: Sep. 16, 1997

[54] SOLE MASSAGING DEVICE

[76] Inventor: Tien Tai Cheng, P.O. Box 82-144, Taipei, Taiwan

[21] Appl. No.: 571,778

[22] Filed: Dec. 13, 1995

[51] Int. Cl.[6] ..... A61H 15/00

[52] U.S. Cl. ..... 601/112; 601/108; 601/111; 601/63; 601/118

[58] Field of Search ..... 601/112–114, 118, 601/27, 32, 49, 63, 99, 90, 86, 87, 104, 108, 111

[56] References Cited

U.S. PATENT DOCUMENTS

| | | | |
|---|---|---|---|
| 2,543,493 | 2/1951 | Gandette et al. | 601/112 X |
| 3,043,294 | 7/1962 | Neff | 601/27 X |
| 3,304,935 | 2/1967 | Kennedy et al. | 601/27 X |
| 4,016,872 | 4/1977 | Yamamura et al. | 601/118 |
| 4,178,921 | 12/1979 | Kosiak | 601/112 |
| 4,721,100 | 1/1988 | Hengl | 601/118 X |

FOREIGN PATENT DOCUMENTS

| | | | |
|---|---|---|---|
| 4020542 | 1/1992 | Germany | 601/112 |
| 2123296 | 2/1984 | United Kingdom | 601/118 |
| 91004001 | 4/1991 | WIPO | 601/113 |

*Primary Examiner*—Danton D. DeMille
*Attorney, Agent, or Firm*—Alfred Lei

[57] ABSTRACT

A sole massaging device including a housing having a base and a cover adapted to be mounted on the base, a driving mechanism including a motor, a driving gear, two brackets, a chain, a driven gear and an axle, a plurality of leaves fastened on the axle and each of the leaves being distant from an adjacent one of the leaves by an angle of 45 degrees, and a rectangular fabric covered on the leaves and having four corners fastened on the base, whereby the device can effectively knead the sole of an user.

1 Claim, 4 Drawing Sheets

SOLE MASSAGING DEVICE

BACKGROUND OF THE INVENTION

1. Field of the Invention

This invention relates to an improved sole massaging device which is designed for lessening pain and stiffness.

2. Description of the Prior Art

It has been found that the conventional massaging device on the market utilizes two rotary wheels to press and rub the body in order to lessen pain, stiffness, etc. However, the distance between the two rotary wheels of such a massaging device is fixed and that is to say, the massaging device cannot be adjusted to fit the body and is completely inappropriate to massage the sole. Hence, a sole massaging device utilizing a rotary axle provided thereon with a plurality of protuberances to massage the sole has been developed to eliminate this drawback. Nevertheless, the sole massaging device only provides the sole with a rubbing effect and cannot be used for kneading the sole.

Therefore, it is an object of the present invention to provide an improved sole massaging device which can obviate and mitigate the above-mentioned drawbacks.

SUMMARY OF THE INVENTION

This invention relates to a sole massaging device.

It is the primary object of the present invention to provide a sole massaging device which can effectively kneading the sole of user.

It is another object of the present invention to provide a sole massaging device which may improve the health.

It is still another object of the present invention to provide a sole massaging device which can be quickly assembled.

It is still another object of the present invention to provide a sole massaging device which is easy to maintain.

It is a further object of the present invention to provide a sole massaging device which is simple and sturdy in construction.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
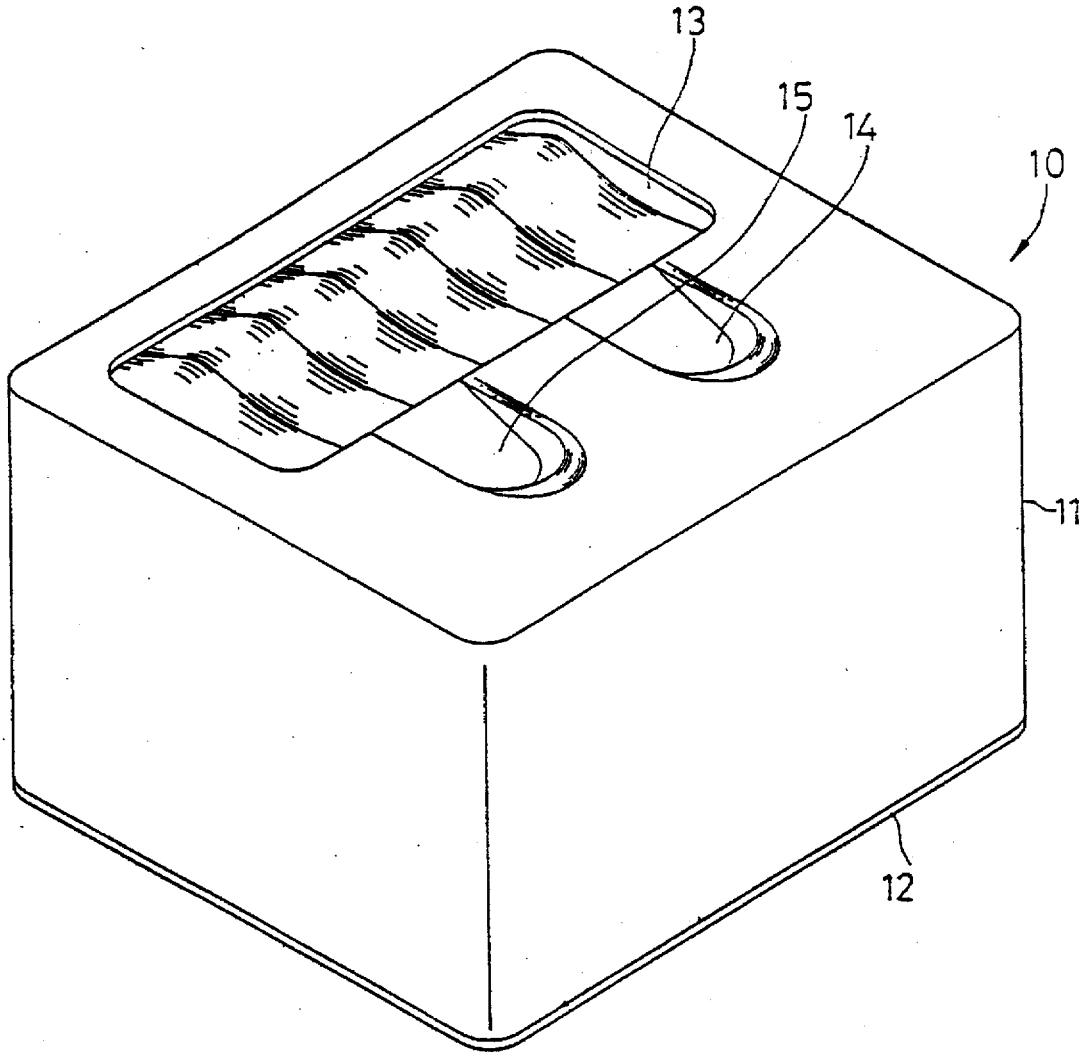
FIG. 1 is a perspective view of the present invention.

For the purpose to promoting an understanding of the principles of the invention, reference will now be made to the embodiment illustrated in the drawings. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
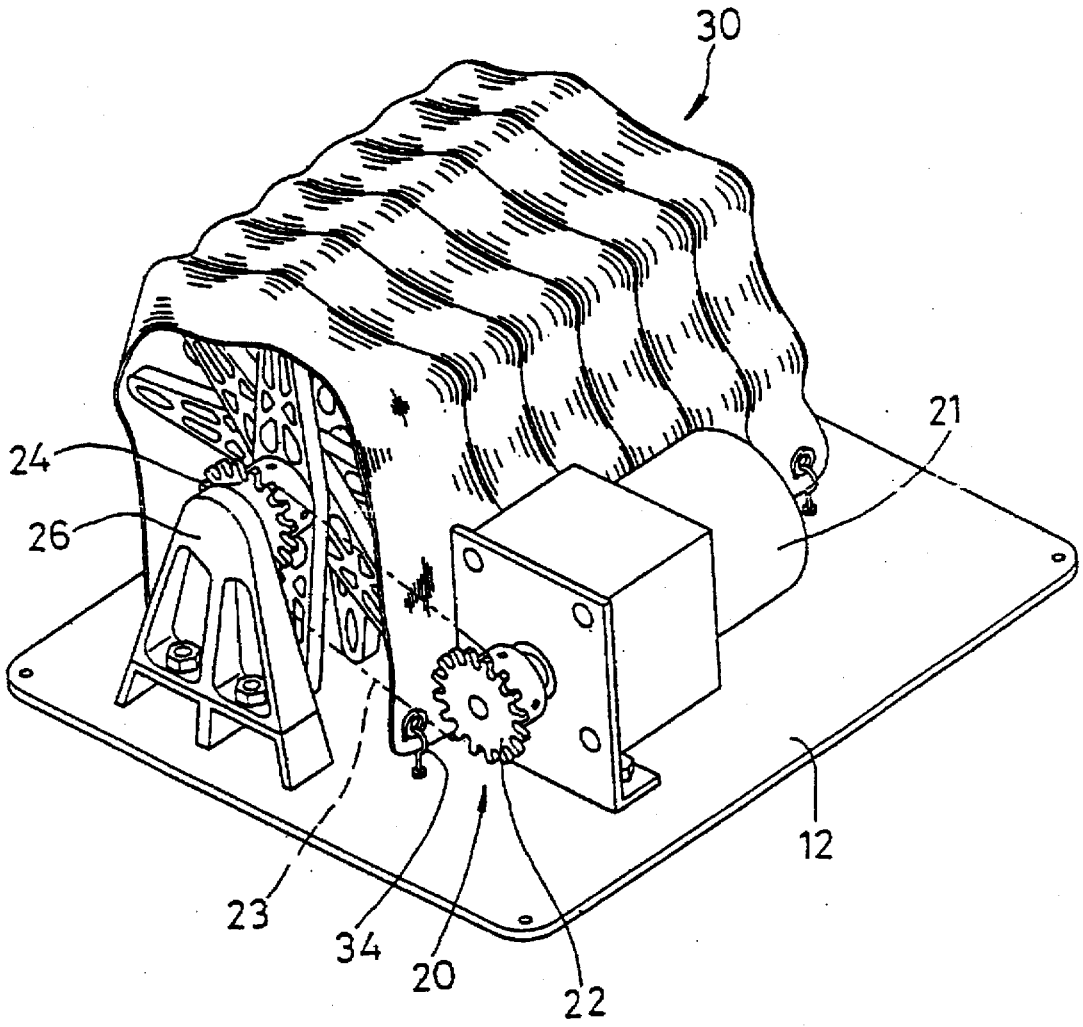
FIG. 2 illustrates the structure of the present invention.
Figure 3:
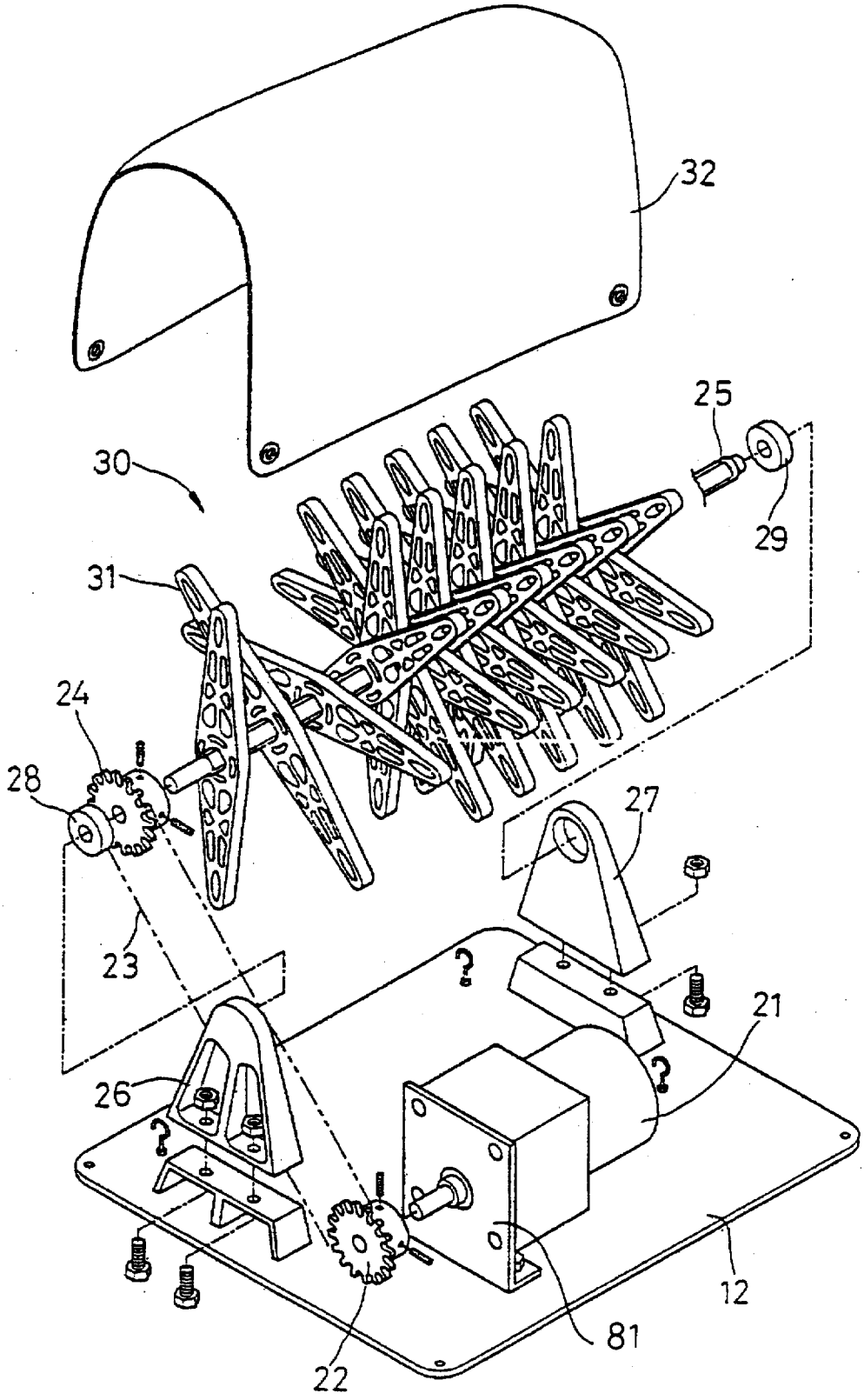
FIG. 3 is an exploded view of the present invention.

With reference to the drawings and in particular to FIGS. 1, 2 and 3 thereof, the sole massaging device according to the present invention mainly comprises a housing 10, a driving mechanism 20, and a plurality of leaves 31.

As shown in FIGS. 1 and 2, the housing 10 includes a base 12 and cover 11 adapted to be mounted on the base 12. The cover 11 is formed at its top with an elongated opening 13 and two recesses 14 and 15 extending from one side of the opening 13. The recesses 14 and 15 are respectively adapted to receive the heels of the left and right feet of an user.

Referring to FIGS. 2 and 3, the driving mechanism 20 includes a motor 21, a driving gear 22, two brackets 26 and 27, a chain 23, a driven gear 24 and an axle 25. The motor 21 is arranged on a frame 81 which is rigidly installed on the base 12. The driving gear 22 is fixedly mounted on an output shaft of the motor 21. The two brackets 26 and 27 are fixedly mounted on two opposite sides of the base 12. Each of the brackets 26 and 27 are provided with bearings 28 and 29, respectively. The axle 25 is supported between the two bearings 28 and 29. The driven gear 24 is fitted on an end of the axle 25 and connected to the driving gear 22 by the chain 23. The axle 25 has two flat surfaces 251 at opposite sides. Each of the leaves 31 is formed at the center with a hole 33 having two flat surfaces at opposite sides so that the leaves 31 can be fitted on the axle 25 and will be rotated therewith (see FIG. 4). As the leaves 31 rotated by the axle 25, the tips of the leaves 31 will protrude out of the elongated opening 13 of the cover 11.

Figure 4:
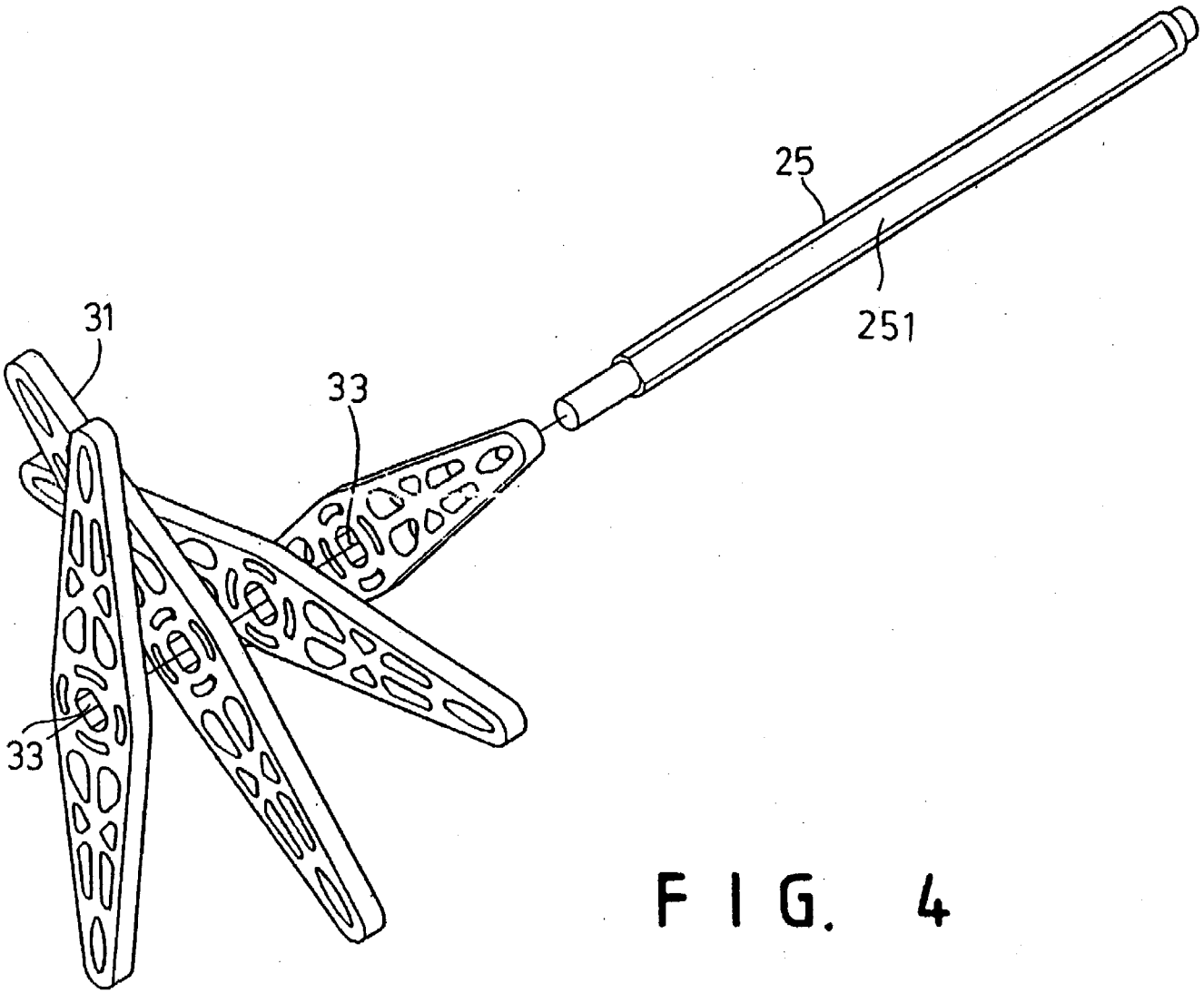
FIG. 4 illustrates how the leaves are engaged with the axle.

Looking now at FIGS. 2, 3 and 4, the leaves 31 are mounted on the axle 25 and each of the leaves 31 is distant from the an adjacent one of the leaves 31 by an angle of 45 degrees. A rectangular fabric 32 is covered on the leaves 31 so as to prevent the leaves 31 from causing hurt to the sole of an user and has four corners fastened on the base 12.

When in use, it is only necessary to put one's heels on the recesses 15 and 14 with the front portions of the soles at the elongated opening 13. Then, the motor 21 is turned on to rotate the leaves 31 thereby kneading and rubbing the soles of the user and therefore lessening pain, stiffness, etc.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A sole massaging device comprising:

a housing including a base and a cover adapted to be mounted on said base, said cover having a top with an elongated opening and two recesses extending from one side of said opening;

a driving mechanism including a motor, a driving gear, two brackets, a chain, a driven gear and an axle, said motor being arranged on a frame which is rigidly installed on said base, said driving gear being fixedly mounted on an output shaft of said motor, said brackets being fixedly mounted on two opposite sides of said base, said axle being supported between said brackets, said driven gear being fitted on said axle and connected with said driving gear via said chain;

a plurality of leaves fastened on said axle and each of said leaves being offset from an adjacent one of said leaves by an angle of 45 degrees; and a rectangular fabric covered on said leaves and having four corners fastened on said base.

* * * * *